United States Patent [19]

Casler et al.

[11] Patent Number: 4,466,267

[45] Date of Patent: Aug. 21, 1984

[54] PROCESS FOR FORMING CURVED STRUCTURES, AND THE RESULTING STRUCTURES

[76] Inventors: William A. Casler, 3487 Barhite St.; Phillip E. Saurenman, 3438 Vosburg St., both of Pasadena, Calif. 91107

[21] Appl. No.: 315,917

[22] Filed: Oct. 28, 1981

[51] Int. Cl.[3] ..... B21D 51/10

[52] U.S. Cl. ..... 72/368; 72/370; 72/398

[58] Field of Search ..... 72/51, 368, 370, 398, 72/471, 356, 377; 228/144, 151; 29/149.5 R, 149.5 DP, 149.5 C; 10/86 R, 152 R

[56] References Cited

U.S. PATENT DOCUMENTS

| | | | |
|---|---|---|---|
| 137,475 | 4/1873 | Parmelee | 72/398 |
| 653,902 | 7/1900 | Bray | 72/471 |
| 1,748,038 | 2/1930 | Leach | 29/149.5 DP |
| 2,077,335 | 4/1937 | Lemming | 29/149.5 C |
| 3,314,266 | 4/1967 | Werther et al. | 72/377 |

FOREIGN PATENT DOCUMENTS

| | | | |
|---|---|---|---|
| 1111112 | 2/1956 | France | 72/356 |
| 1325320 | 8/1973 | United Kingdom | 72/398 |

*Primary Examiner*—Lowell A. Larson
*Attorney, Agent, or Firm*—Donald D. Mon

[57] ABSTRACT

Curved metal structures such as cylinders, circumferential parts of cylinders, tubes, and circumferential parts of tubes formed from flat stock have reformed protrusions in limited areas in order more accurately to position mating parts. The flat stock is formed to its cylindrical or tubular shape with known onestroke die-mandrel techniques, and near and at the end of the forming process there also is a concurrent precision reforming of limited sections of the formed stock by localized radial thinning of the material. When precisely-located radial and axial surfaces are desired at an end of the structure, then this is done at an axial end at least by related localized elongation and cold working of material into contact with a die wall. When a precise internal surface is desired, the reforming and cold working can be done at a substantial distance from the end.

9 Claims, 10 Drawing Figures

PROCESS FOR FORMING CURVED STRUCTURES, AND THE RESULTING STRUCTURES

FIELD OF THE INVENTION

This invention relates to curved metal structures formed from flat stock by one-stroke die-mandrel techniques, and to processes for making them. Examples are metal cylinders, circumferential parts of cylinders, tubes and circumferential parts of tubes.

BACKGROUND OF THE INVENTION

In the manufacture of metal cylinders such as for electric motor housings it is common to use mating mandrel and die metal forming techniques. With these techniques there often are difficulties in maintaining the squareness, circularity and diameter control which are desired at the ends of the cylinders where they engage, locate and align next assemblies, or internally where they receive and locate a next assembly. Furthermore, close control of the total cylinder length is often desirable in order to optimize assembly operations and product performance. Sometimes there also are special requirements for end counterbore diameters which are somewhat different than the main cylinder diameters, or for special non-circular features at the end of the cylinder such as axial or radial "stands" or extensions to position mating parts. Also, there are circumstances where a centrally-mating part must be accommodated by an arcuate and accurately located circumferential surface.

The ability to control length, squareness, circularity, bell-mouthing, and mating surface characteristics of fabricated cylinders is limited by the inherent characteristics of the cut metal stock, and of the die-mandrel metal forming processes. Limitations in stock-tooling alignment, and variations in the thickness and/or width of the unformed stock, and in its bending, hardness, and springback characteristics, result in variations in the formed cylinders. These variations are particularly evident at the ends and inside diameters of the cylinders.

The ends of curved elements such as cylinders are usually vital areas with respect to proper fit and alignment with mating parts. Often a second machining operation must be performed on the ends of formed metal closures, and in some cases even on cutoff tube lengths, to control the squareness or circularity at the ends. This is also true in die-forming techniques, even when the forming tools include stock edge restraint. In fact, if edge restraint clearances are tight, even slight variations in stock width or alignment can create edge burrs and misformed parts. As to accurate counterbore diameters, and non-circular edge positioning features, with known techniques they are not reasonably provided for during single stroke processes for forming curved structures. Neither are close inside diameters.

It is an object of this invention to provide improved curved structures which are "precision-reformed", and efficient diemandrel techniques for making such shapes which can uniformly produce a product which is well within common tolerance requirements of such parts. These parts are useful without requiring resort to such expedients as self-aligning bearings and special end-play spacers, or secondary operations such as machining of the ends of the structure.

In fact, with this invention, housing assemblies and other curved structures can be made with precision comparable to cavityformed parts, but they can instead be made on conventional punch press equipment. A one-stroke press operation can be made to give results at least equal to those obtained with cut-off tubular workpieces.

BRIEF DESCRIPTION OF THE INVENTION

According to this invention, when making curved structures from flat stock, the dimensional control of the resulting parts is improved by adding to the terminal portion of the circumferential forming process, a concurrent tri-axial reforming process in which at edges or other limited portions of the curved structure, the metal stock is reduced in thickness and thus is forced to flow axially and radially into at least partial conformity with cavity restraints in the die-mandrel system. This is accomplished by adding to a basic cylindrical forming die set (two or more forms) one or more different interfering diameter areas over a limited axial length where the wall thickness of the material will be reduced. This provides less clearance than the thickness of the metal, and therefore cold works or swages the metal radially and axially to the tool restraints. This final precision-reforming process occurs in a relatively narrow band which extends around most, but preferably not all of the periphery, and occurs after the primary forming of the structure is substantially complete. Therefore it can be accomplished without creating burrs, scuffs, or other undesired deformities. Since the reformed portions are deformd beyond the yield strength of the metal, the tendency for springback deformation is substantially eliminated.

According to an optional feature of the invention, a limited portion of a diameter on one end of the mandrel could be increased with an appropriate change in the facing mating diameter of the die, thereby to provide accurate counterbore shapes in the structure.

According to another optional feature of the invention, the opposite end of the forming mandrel (the end from which the formed part is removed) could be reduced in diameter with the die having appropriate reductions in edge diameter and stock clearance so as to produce a precisely formed reduction in inside or outside diameters of the curved structure along with the previously described axial extrusions into partial conformity with cavity end restraints.

According to yet another optional feature of the invention, one or more reformed ring areas can be provided in the mid-section of the outer diameter forming dies to force stock of varying thicknesses into close conformity to the forming mandrel without breaking or incapacitating the forming tools, thereby forming an inside region of closely controlled diameter and concentricity.

The above and other features of this invention will be fully understood from the following detailed description and the accompanying drawings, in which:

DETAILED DESCRIPTION OF THE INVENTION

Although unique combinations of metal working processes are involved, the invention in itself is elegantly simple. It utilizes a conventional one-stroke punch press that brings at least one die (usually a plurality of die segments) and a mandrel against opposite sides of a workpiece. The process involves the use of an appropriately shaped mandrel 20, which usually will be cylindrical. It will be "circularly" sectioned. It will have a length suitable for forming the curved structure. Because the most frequent application of this invention will be the making of cylinders, this application will be described in detail. The making of other curved structures can readily be understood from this example by persons skilled in the art.

To form a cylinder or closed tube, there is included a die set which includes die segments 21 and 22. The die segments have walls 23 and 24, respectively, which are circularly sectioned and have a respective inner diameter. Because die segments 21 and 22 are similar for purposes of this invention, only segment 21 will be described in detail. As can best be seen in FIG. 3, the die segments can close toward one another with normal clearance for stock so as to form a cylinder with the part between them.

Figure 2:
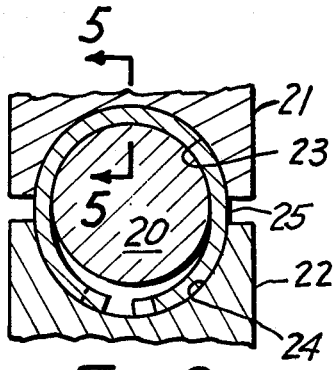
Figure 3:
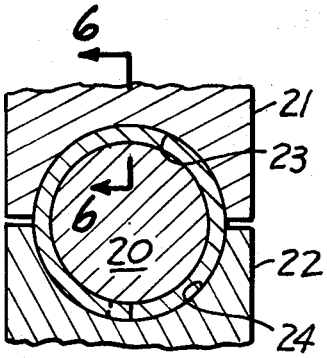

Workpiece 25 is metallic, for example low carbon steel, and is made from initially flat sheet or plate. According to one convenient form of the invention, a tongue 26 is formed on one end of the sheet and a recess 27 is formed in the other end. The sides of the sheet ultimately form the ends of the curved structure. The tongue and recess may be interlinked with one another by known techniques. The workpiece often is initially formed to a U-shape, by being wrapped 180° around the mandrel in this example. For this purpose, the upper die and the mandrel are brought toward one another. Next the die segments are brought toward one another, while the mandrel and upper die are kept pressed against the workpiece. The edges of the workpiece are progressively moved toward one another, as shown in FIGS. 2 and 3 until a cylinder is formed. When tongues and recesses are used, they interdigitate near the end of the process. It is preferred practice for the mandrel and upper die segment 21 to be brought together, after which the lower segment 22 engages the mandrel/upper die/workpiece assembly. The specific sequence utilized is immaterial so long as the tri-axial forgoing or extrusion type precision cold reworking occurs concurrently with the terminal part of the cylinder forming operation.

Figure 4:
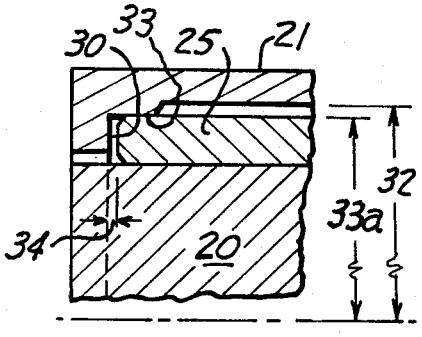
FIGS. 4, 5 and 6 are fragmentary cross-sections taken at lines 4—4, 5—5, and 6—6 respectively in FIGS. 1, 2 and 3.

Further with regard to the die-mandrel system, as shown in FIG. 4 where a portion of die segment 21 is shown, the die segment includes an interior end face 30 which faces axially toward workpiece 31. The segment has a basic inner diameter 32 to which the major portion of the part will be formed, and a reforming section 33 of relatively short length near the end face. This has a reduced diameter 33*a*. The reforming section is formed on both die segments 21 and 22 at the same end. If desired, it may be formed at both ends (as it usually will be).

Figure 5:
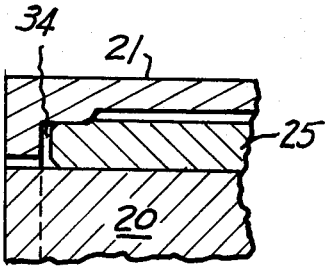
Figure 6:
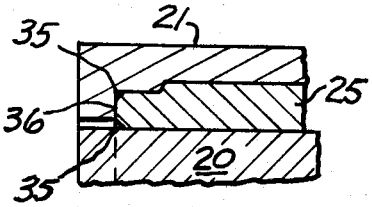

Progressive formation of the workpiece into a cylindrical part after it has first been bent to a U-shape by die member 21 and the mandrel is shown in FIGS. 4, 5 and 6 where it will be seen that a progressive curling action of the piece takes place with initial contact near the ends, but perhaps with some bowing contact near the center. FIG. 4 shows a position near the start after the sheet has been formed to a U-shape. FIG. 5 shows a position toward, but not yet at the end of the formation. FIG. 6 shows the completed structure. As can be seen from a comparison of FIGS. 5 and 6 the reforming operation, i.e., the edge re-forming or swaging process begins near the end of the stroke and continues to the end of the stroke concurrent with completion of the basic cylinder forming operation.

For example, in FIG. 6 the die is shown closed against the workpiece on the mandrel. The cavity between them is generally filled. However notice in FIGS. 4 and 5 that there is a spacing 34 between the end of the workpiece and the end face (exaggerated in size for purposes of illustration) in order to accommodate variations in stock width and stock-tool alignment. This spacing has largely been eliminated in FIG. 6, because the closure of the die set against the workpiece and the mandrel has caused radial compression and a resulting axial extension of the metal toward and against the end face. This "precision-reforming" of the end produces protruding mating surface extremities on the part which are flat and normal to the axis, because they are formed to and by abutment with a precision die surface. This terminal reforming part of the process also radially resets end area ID surfaces of the part to conform precisely to the mandrel OD surface.

Figure 7:
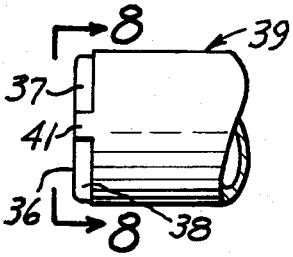
FIG. 7 is a side elevation of cylinder resulting from the foregoing.
Figure 8:
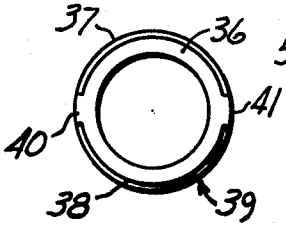
FIG. 8 is an end view taken at line 8—8 in FIG. 7.

In FIG. 6, voids 35 are shown which indicate that the end edges may not be sharp, but there will be at least some flat surface 36 at the end (see FIGS. 7 and 8). Also, as shown in FIG. 8, there normally will be reformed areas 37, 38 in part 39, with unreduced areas 40, 41 at both sides. In fact, imperfections intrinsic in the stock often will leave characteristic or random voids on the surfaces of the reformed ends. However, and most importantly, major "mating-part" portions of the end surfaces 36 will have been reworked to be true and square relative to the axis, and to have more precise radial conformity to mandrel and die surfaces. This is sufficient for accurate positioning of next assemblies at the end. If desired, the interfering projections of each die can be interrupted rather than continuous so that the end is provided with a plurality of "stands" (not shown).

Figure 9:
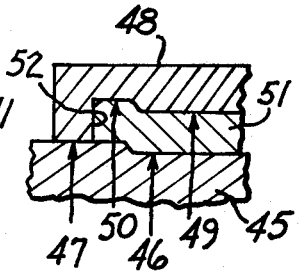
FIGS. 9 and 10 show two other embodiments of a process according to the invention.

FIG. 9 shows a technique for forming an internal counterbore at an end of a cylinder in the same type of process. In this case a mandrel 45 has a basic diameter 46 and an enlarged diameter 47. The die has a basic diameter 49 and an enlarged diameter 50. The spacing between diameters 47 and 50 is less than the spacing between the basic diameters 46 and 49 so that cold-flow type reforming is accomplished with the final cylindrical forming. The end portions of the part 51 are reduced in thickness so there has been a radial reduction in area and a resulting axial cold-flow movement of metal against end face 52 of the die, while both walls have been moved to form the counterbore and finish-form the cylinder as a structure.

Figure 10:
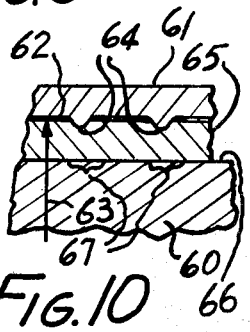

FIG. 10 shows yet another embodiment of the invention where primarily radial movement of the metal is provided for, and this movement is caused by actions taken at locations spaced away from the end, rather than contiguous to the end. This is for the purpose of providing areas to receive internally mating next assemblies.

Figure 1:
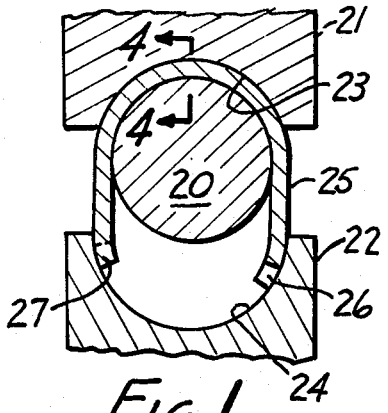
FIGS. 1–3 are cross-sections of a mandrel-die system showing the progressive formation of an initially flat piece of metal into a cylindrical shape.

In this embodiment, a mandrel 60 has a constant diameter. A die segment 61 (there being another similar die segment opposed to it as in FIG. 1) has over most of its length a basic diameter 63, resulting in a clearance 62 for stock thickness. However, a group of bands 64, or other limited stock interference areas of reduced diameter, are provided at various locations along the length, whereby when the dies are closed against the mandrel with the part 65 between them, there is radial movement and/or yielding of metal as necessitated by stock thickness so that the finished part conforms closely to mandrel surface 66, especially at regions 67 axially aligned with bands 64 notwithstanding variations in the thickness of the base stock which could otherwise leave voids between the mandrel and the finished part.

In all embodiments, the end faces can be duplicated at both ends. In the case of FIG. 9, the mandrel would then have to be split so that it can be withdrawn from the part at both ends.

Instead of using two die segments, three or more may be provided. An important feature of this invention is that there be a substantial reduction of wall thickness somewhere on the part resulting from radial and axial movement of metal and yielding of metal in selected areas where precision reforming is desired. Preferably this occurs at one or both ends of the part, and this is the situation of FIGS. 1–8. However, both ends need not be identically treated, or both even treated at all.

The coined sections may penetrate the metal to between about 5% to about 25% and sometimes more, of the wall thickness. The axial length of the reformed section will vary anywhere from a fraction of the original wall thickness to about twice the original wall thickness.

As already noted, cylinders, tubes, and curved structures as made by existing die/mandrel sheet metal forming techniques are limited in their ability to accurately align and position end mating parts, this being due to inherent variations in stock width, cut edge squareness, tool positioning, etc. For example, a 3 in. diameter by 3/16 in. thick conventionally-formed cylinder typically can have as-formed length and parallelism variations of 0.020 to 0.030 in. or more. Similarly, the effectiveness with which a formed tube can radially locate internal mating parts is limited by variations in the thickness of the stock, by "spring-back" characteristics of the material, by bending stresses, by resulting bell-mouthing, and by the fact that formed cylinders tend to be shaped to the inside diameter of the die cavity, whereas conformity to the mandrel outside diameter is often desired.

With the cylinder structures and processes disclosed it is, for example, practical in 3″ diameter cylinders to maintain end-parallelism, squareness and length within 0.005 inc. or less-i.e., within typical machined part accuracies. As to radial positioning of mating parts (all embodiments including FIGS. 9 and 10), the triaxial cold-flow processing of key portions of the cylinders strains the metal structure beyond its yield point, and thereby essentially eliminates the "spring-back" and other types of conventional radial assembly inaccuracies.

It should be noted that although the yielded or reformed protrusions at mating surfaces of curved structures according to this invention do not normally extend around the entire periphery of the structure, they do provide more than adequate precision surface to accurately position and support mating parts. The limited, and interrupted, circumferential forged or cold worked surfaces evident only near engaging-surface portions on the formedmetal structures are, of course, distinctive characteristics of the improved cylinder structures themselves, as well as of the preferred processes described for making them.

The "cold forge" type of reforming which occurs near the "arch" center of the cylindrical die cavity results from straight compressive action on the surface of the stock, whereas near the parting line edges of the die cavity the closing geometry is tangential, which exerts a sliding action between die and stock surfaces as the radial compression and resulting axial flow ("precision reforming") is accomplished. This combined sliding and cold forming action tends also to move metal circumferentially, and can cause burrs and surface extrusions at the leading edges of the die cavity. To avoid this the interferring "reform" sections in the die or mandrel surface are eliminated or tapered to the basic cylindrical forming surface as they approach the closure edge of the die. Thus, the completed part will preferably not be reformed at regions 90° from the center of the original bend. This effect will be less pronounced, or even non-existent, if more than two die segments are used, which is within the scope of the invention.

The term "curved structure" includes any structure formed to a non-planer configuration that has a longitudinal axis. A cylinder is a common example, and has widespread usage. However, circumferential segments of cylinders, such as $\frac{1}{4}$, $\frac{1}{3}$, $\frac{1}{2}$, $\frac{2}{3}$ or $\frac{3}{4}$ cylinders are also useful, and can be formed with the process of this invention. If the structure is $\frac{1}{2}$ of a cylinder's circumference or less, then the second die is not necessary, and the complete construction is completed by the mandrel and one die. If there is more than $\frac{1}{2}$ cylinder circumference, a second and perhaps a third die will be used.

Also, curved structures can be formed which include flat portions, such as square tubing, by appropriate and evident shaping of the mandrel and die or dies. These too, can be formed as less than fully peripheral tubes.

In this invention's process, just before and concurrent with completion of basic curvature formation of the part, limited extremeties of the forming mandrel and mating dies close to clearance dimensions which will be less than the thickness of the metal, and within tool restraints which trap the remainder of the structure. Then the material at these locations is reduced in thickness, and extended against the end restraint so as to be precisely reformed into accurately located axial and radial surfaces.

In this invention, to produce "precision-reform" protrusions (preferably concurrently with the final cylindrical forming stage of a continuous, one stroke die-mandrel type forming operation) one or both of the die or mandrel tools have, in addition to their primary forming geometry, radially extended sections around substantial circumferential portions and on only limited axial portions of their working surfaces—so that upon final die-mandrel closure there is in the "precision reform" areas significant interference with normal die-mandrel-stock clearances. Thus a single die closure stroke serves both to finish-form the flat stock to its cylindrical shape, and to produce at the limited "precision reform" areas a radial "cold forge" type of compression with concomitant bulk yielding and axial extension of the form stock—into at least partial conformity with cavity end restraints provided in the die or mandrel structure.

While a conventional punch press will preferably be used, the invention is not to be limited to use with punch presses. Any metal forming technique that can bend the metal strip or plate to the curvature desired and, during the terminal part of the formation, accomplish the localized precision reforming, will be suitable.

Thus, there has now been shown improved formed metal structures and new methods of making them with the use of a simple one-stroke punch press and a mandrel-die metal forming technique.

This invention is not to be limited by the embodiments shown in the drawings and described in the description which are given by way of example and not of limitation, but only in accordance with the scope of the appended claims.

We claim:

1. The process of forming a metal cylinder which has a central axis, a dimension of axial length, and an inner and outer wall from a sheet of metal having a uniform dimension of wall thickness, a pair of ends, and a pair of edges, said process comprising:

using a mandrel having an outer surface with the shape of the desired inner wall of the structure and a plurality of die members, each die member having an inner wall surface providing die-mandrel closure clearance substantially equal to said wall thickness over the major portion of said axial length when said die members are closed, an interior end face extending radially and facing toward said inner wall surface, one of said surfaces including an arcuately extending portion more closely approaching the axially aligned portion of the other surface than other portions of said one surface when the die members are closed, placing said sheet of metal between said surfaces and moving said die members and mandrel toward one another and against said sheet, whereby to curve said sheet into a cylinder, there being a lesser resulting wall thickness at said arcuately extending portions because of their closer approach, said arcuately extending portions thereby causing, toward the final closure of the die members both radial and axial flow of metal at an end of said cylinder into at least partial contact with both said arcuately extending portion and with said interior end face whereby to form an end on said cylinder of reformed metal conforming with at least portions of two defining surfaces of each said die member.

2. A process according to claim 1 in which a second of said die members closes against said sheet only after said first of said die members and said mandrel have been brought together against said workpiece to form said workpiece to a U-shape.

3. A process according to claim 1 in which said arcuately extending surface is adjacent to said interior end face, and extends for less than an approximately 180° extent of each die member, whereby a pair of regions located about 90° from the mid-point of the curved sheet are formed without substantial reduction of wall thickness.

4. A process according to claim 2 in which said arcuately extending surface is adjacent to said interior end face, and extends for less than an approximately 180° extent of each die member, whereby a pair of regions located about 90° from the mid-point of the curved sheet are formed without substantial reduction of wall thickness.

5. A process according to claim 3 in which said arcuately extending surface is contiguous to said interior end face.

6. A process according to claim 1 in which, adjacent to said interior end face and relative to the diameters of said major portion of axial length, the diameter of the outer surface of the mandrel is enlarged, and the opposing diameter of the inner surface of the inner wall is also enlarged but by a smaller amount to form said arcuately extending portion, whereby to form an enlarged counter-bore type end.

7. A process according to claim 6 in which a second of said die members closes against said sheet only after said first of said die members and said mandrel have been brought together against said workpiece.

8. A process according to claim 7 in which said smaller amount by which the diameter is enlarged extends less than an approximately 180° extent of each die member, whereby a pair of regions located at the circumferential ends of the die-formed sheet are formed without substantial reduction of wall thickness.

9. A process according to claim 1 in which said inner wall surface of said die within said major portion of axial length includes at least one band-like portion with reduced diameter, whereby to cause radial conformity of the metal sheet to the mandrel in the event that actual metal thickness is less than said wall thickness and said closure clearance, and alternately to accommodate metal equal to said wall thickness and said closure clearance without impairing normal operation of the said die and said mandrel.

* * * * *